US005542481A

United States Patent [19]

Scott

[11] Patent Number: 5,542,481

[45] Date of Patent: Aug. 6, 1996

[54] DRIVE POINT LOCKING METHOD AND APPARATUS

[75] Inventor: Gregory H. Scott, Salina, Kans.

[73] Assignee: Kejr Engineering, Inc., Salina, Kans.

[21] Appl. No.: 419,128

[22] Filed: Apr. 10, 1995

[51] Int. Cl.[6] ..... E21B 49/02

[52] U.S. Cl. ..... 175/23

[58] Field of Search ..... 175/20, 21, 22, 175/23

[56] References Cited

U.S. PATENT DOCUMENTS

| | | | |
|---|---|---|---|
| 955,729 | 4/1910 | Welsh | 175/23 |
| 1,906,706 | 5/1933 | Moore | 175/23 |
| 1,969,251 | 8/1934 | Bald | 175/23 |
| 1,979,599 | 11/1934 | Bald et al. | 175/23 |
| 2,283,650 | 5/1942 | Sanborn | 175/23 |
| 5,186,263 | 2/1993 | Kejr et al. | 175/23 X |

*Primary Examiner*—William P. Neuder

[57] ABSTRACT

An assembly for locking the drive point at the forward end of an elongated sample tube includes a tapered drive point presenting a threaded chamber, a bolt having a threaded stem, a collar disposed about the stem and a locking member disposed about the stem and adapted for engaging a recess near the forward end of the tube. The bolt head may present a tool receiving slot for remotely releasing the locked drive point assembly. The bolt stem may include a recessed groove for receiving a setscrew through the drive point to ensure that the bolt does not become completely disengaged from the drive point when the point is released from the forward end of the sample tube.

25 Claims, 2 Drawing Sheets

DRIVE POINT LOCKING METHOD AND APPARATUS

BACKGROUND OF THE INVENTION

The present invention relates in general to a locking device for a drive point assembly and, more particularly, to a method and apparatus for releasably locking the drive point at the forward end of an apparatus such as a soil sampling probe.

For many years, soil samples have been obtained to determine soil conditions prior to construction of structures on the ground and to locate certain mineral deposits. Furthermore, these samples may be used for studying chemical dissipation and residue, for determining the concentration of environmental contaminants, for investigating hazardous waste sites and for other uses well-known in the art. The fundamental requirements for a soil sampling probe include the ability to penetrate the soil to a desired depth, to obtain a sample of soil at the desired depth and to remove the probe from the ground with the sample intact. To this end, it is desirable to provide a durable drive point at the forward or leading end of a soil sampling probe to penetrate the soil. The point must be firmly coupled to the probe to be able to withstand the forces associated with static or percussion driving techniques. Importantly, the drive point must be capable of being released from the forward end of the probe at any desired depth so that a soil sample may be taken into the sample chamber of the probe.

A prior art soil sample probe is described in U.S. Pat. No. 5,186,263 to Kejr et al., which is owned by the assignee of the present invention and is hereby incorporated by reference. The drive point assembly disclosed in the '263 patent utilizes a piston stop and an elongated piston rod to maintain the drive point at the forward end of the sample tube as the probe is driven into the ground. This prior art construction presents several design problems. First, the piston rod must be about the same length as the sample tube, which is typically four feet long. As the probe is driven into the ground, the relatively slender piston rod must absorb the resistive force encountered by the point and is therefore subject to buckling. Likewise, the strength of the connection between the piston stop and the drive head must be sufficient to withstand the force imparted to it from the piston rod. Moreover, a conventional drive point presents a shoulder which abuts a mating shoulder at the forward end of the sample tube and which may be exposed to shearing forces. Such a construction is relatively expensive and is inherently subject to the possibility of damage during use.

Another problem associated with prior art drive points such as the assembly disclosed in the '263 patent involves the process of extracting the probe from the ground. Typically, a plurality of probe extensions are connected to the sample tube as the probe is driven into the ground, and the specific number of probe extensions added will be dictated by the desired sample depth. Preferably, a pull cap is used to extract the probe from the ground, one section at a time. However, when the soil sample which is taken into the sample tube forces the drive point to the top of the sample tube, the piston rod connected to the drive point protrudes upwardly through the drive head and several feet into the adjoining probe extension. Consequently, after the last probe extension has been removed, the pull cap cannot be placed over the sample tube due to the protruding piston rod. Therefore, some additional equipment, which is otherwise unnecessary, must be used to remove the sample tube from the ground.

SUMMARY OF THE INVENTION

The present invention is directed to an improved drive point assembly, including an extendable locking member. The invention overcomes the problems and limitations set forth above by providing an assembly that does not protrude above a filled sample tube so as to interfere with the retraction of the probe from the ground. Furthermore, the invention eliminates the need for a conventional piston rod and piston stop, thereby simplifying the construction of the probe.

Accordingly, it is an object of the present invention to provide a drive point assembly having a self-contained locking member for releasably locking the drive point at the forward end of a probe.

It is another object of the present invention to provide a method for locking a drive point at the forward end of a probe by using a self-contained locking member.

It is yet another object of the present invention to provide a method and apparatus for remotely releasing a drive point locked at the forward end of a soil probe so that a sample may be taken within the probe.

It is still another object of the present invention to provide a drive point assembly featuring a locking mechanism in close proximity to the drive point.

A further object of the present invention is to provide a drive point assembly that may be conveniently disassembled for cleaning and decontamination.

It is also an object of the present invention to provide a drive point assembly that is compatible with existing sample probes so that it will be convenient to retrofit such a probe.

Still a further object of the present invention is to provide a durable drive point assembly that is less susceptible to shearing forces but still capable of withstanding the forces associated with percussion driving.

These and other related objects of the present invention will become readily apparent upon further review of the specification and drawings. To accomplish the objects of the present invention, a drive point assembly is provided comprising a tapered drive point presenting a threaded chamber or bore, a bolt and a locking member adapted for locking the drive point at the forward end of an elongated tube. A collar may be provided to facilitate movement of the locking member into an extended position when the bolt is advanced into the chamber.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE DRAWINGS

Figure 1:
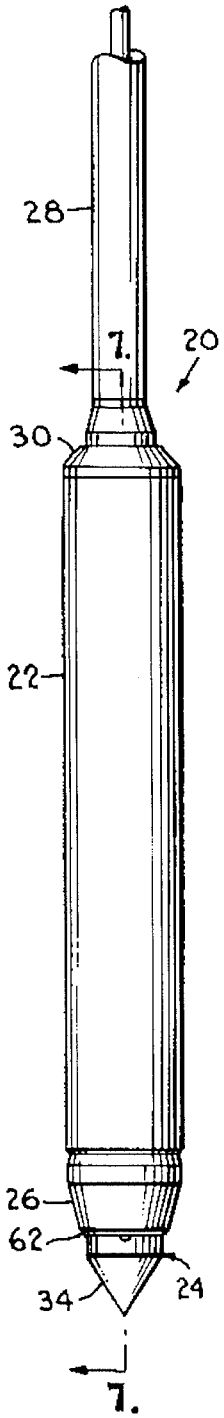
FIG. 1 is a fragmentary front elevational view of the soil sampling probe in accordance with a preferred embodiment of the present invention.

Referring to the drawings in greater detail, and initially to FIG. 1, the soil sampling probe of the present invention is designated generally by reference numeral 20. Probe 20 comprises a sample tube 22, a drive point assembly 24, a cutting shoe 26, a probe rod 28 and a drive head 30. Assembly 24 may be releasably locked to cutting shoe 26, which is affixed to the forward end of sample tube 22 by a threaded connection. However, shoe 26 may be connected to tube 22 by any other means known in the art (e.g., a tube having a cutting shoe formed integrally therewith). Drive head 30 is connected to the opposite end of sample tube 22 and couples probe rod 28 with tube 22.

Figure 2:
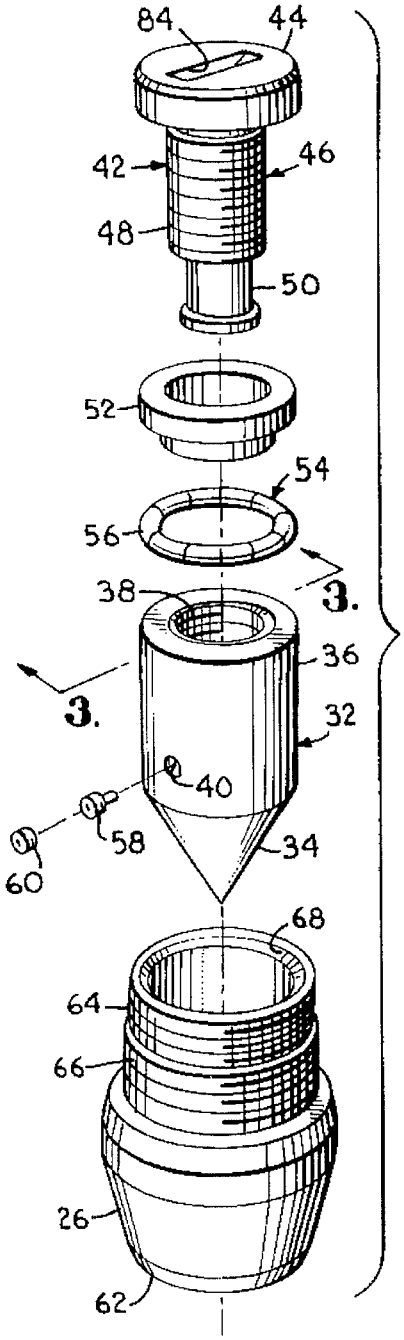
FIG. 2 is an exploded perspective view of the drive point assembly and cutting shoe in accordance with a preferred embodiment of the present invention.

Drive point assembly 24 and cutting shoe 26 are illustrated in greater detail in FIG. 2. Assembly 24 includes a drive point 32 having a conical lower section 34, which is tapered to optimize penetration into the ground, and a cylindrical upper section 36. The upper section 36 may be slightly tapered (e.g., at a one degree angle) to prevent point 32 from sliding out the forward end of shoe 26 and further to provide a seal between point 32 and shoe 26 while realizing significant clearance as the point 32 moves longitudinally within the shoe 26. Furthermore, upper section 36 presents a threaded chamber 38 and an aperture 40 for receiving a setscrew.

Assembly 24 further includes a bolt 42 having a bolt head 44 and a bolt stem 46. Stem 46 comprises a threaded portion 48 for engaging threaded chamber 38 and a groove 50 for receiving a setscrew. A bearing or collar 52 and a toric locking member 54 are disposed intermediate the bolt head 44 and the drive point 32. It is presently preferred that locking member 54 embody a ring or torus wherein a plurality of ring segments 56, which are circular in cross-section and are each bored to receive a helical spring 74 (shown in FIGS. 3–10) with its ends connected to form an annulus that holds the segments together and biases them to their retracted positions. A setscrew 58 may be received in groove 50 through threaded aperture 40 extending through the sidewall of point 32, and a setscrew cap 60 may be coupled to setscrew 58 within aperture 40 for holding setscrew 58 in position and for protecting the setscrew and the aperture threads. As shown in FIG. 2, cutting shoe 26 presents a cutting edge 62 at its forward end, a pair of different threaded surfaces 64 and 66, respectively, at its opposite end and an inner surface 68.

Figure 3:
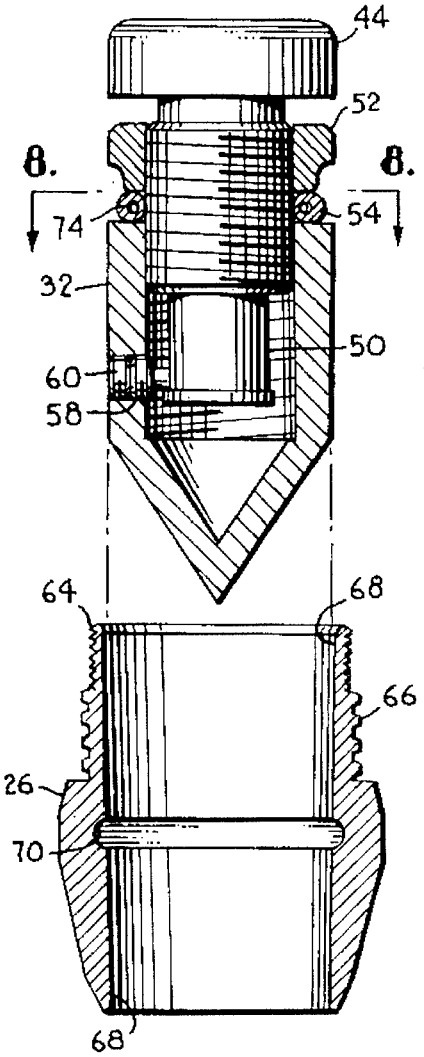
FIG. 3 is a partially exploded cross-sectional view taken along line 3—3 of FIG. 2 but showing parts in their assembled positions.

In FIG. 3, assembly 24 is depicted with setscrew 58 extending into groove 50 and with member 54 in its retracted position. Accordingly, assembly 24 may be slidably telescoped into cutting shoe 26. Preferably, the inner surface 68 of cutting shoe 26 is slightly tapered so that assembly 24 can enter from the upper end of the shoe without sliding out the forward end. Furthermore, as mentioned above, the tapered inner surface 68 cooperates to enhance the seal between point 32 and shoe 26 and allows point 32 to more readily move up the shoe 26. Inner surface 68 also has an inwardly open, annular recess or groove 70 formed therein and disposed for receiving member 54 in its extended position as will be further explained.

Figure 4:
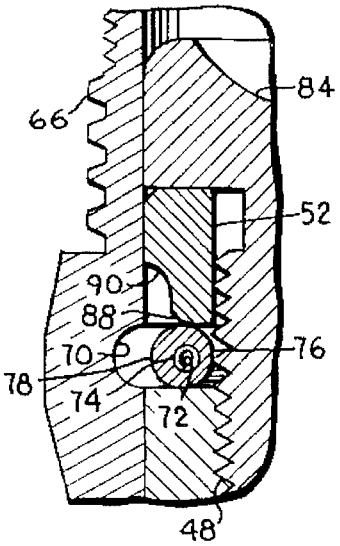
FIG. 4 is an enlarged fragmentary cross-sectional view of the drive point assembly with the locking member in its retracted position.
Figure 5:
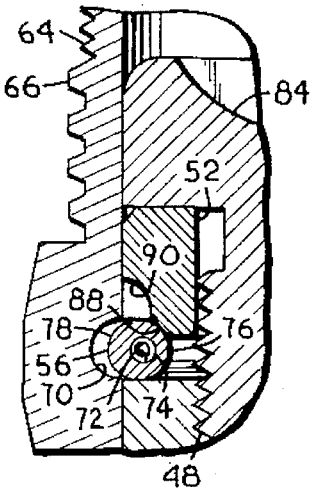
FIG. 5 is a view similar to FIG. 4 but showing the locking member in an intermediate position.
Figure 6:
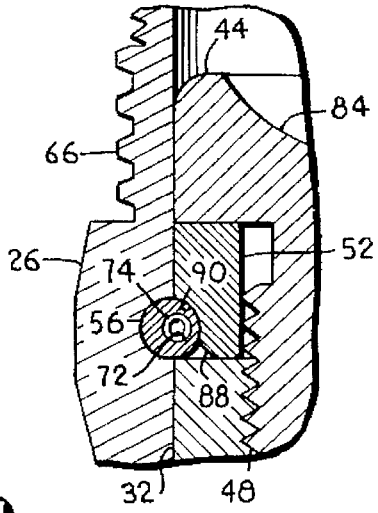
FIG. 6 is a view similar to FIGS. 4 and 5 but showing the locking member in its extended position.

As shown in FIGS. 4–6, due to the circular exteriors of the segments 56 and the adjacent camming surface of the collar 52, the latter forces member 54 from its retracted position (FIG. 4) to its extended position (FIG. 6) as bolt 42 is advanced into the threaded chamber 38. In FIG. 6, member 54 is fully extended with the outer half of the member complementally received into recess 70 in cutting shoe 26. Each ring segment 56 has a transversely extending bore 72 through which spring 74 passes, thereby maintaining segments 56 in a ring configuration. As shown in the drawings, the bores 72 in segments 56 are preferably formed eccentrically (i.e., slightly offset in the direction of stem 46). With this configuration, spring 74 tends to keep the segments properly positioned with an inner contacting surface 76 of each segment 56 disposed inwardly of spring 74 and an outer contacting surface 78 of each segment 56 disposed outwardly of spring 74. Preferably, surfaces 76 and 78 define complementary arc-shaped portions of each segment 56. Consequently, inner surfaces 76 mate with collar 52 and outer surfaces 78 mate with recess 70 when ring 54 is in its extended position as shown in FIG. 6.

Figure 7:
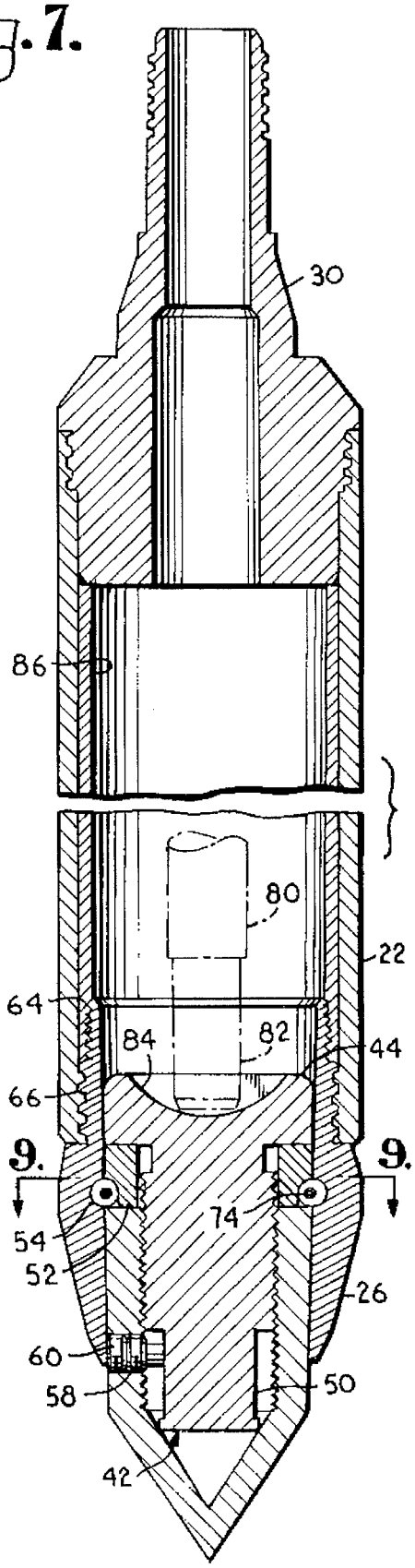
FIG. 7 is a cross-sectional view of the probe taken along line 7—7 of FIG. 1 with phantom lines showing the release rod engaged with the drive point assembly.

Referring next to FIG. 7, bolt 42 may be moved upwardly or downwardly by turning the bolt with an elongated release rod 80 having a tool head 82 at its forward end for matingly engaging a slot 84 formed in bolt head 44. FIG. 7 also depicts setscrew 58 extending into groove 50 and cap 60 in covering relationship over setscrew 58 in aperture 40. An elongated cylindrical liner 86 for collecting the soil sample may be adapted to engage inner threads 64 of cutting shoe 26. Depending on soil conditions, a material such as plastic, teflon, stainless steel or brass may be selected for liner 86. Sample tube 22 may be adapted to engage outer threads 66 of cutting shoe 26 so that tube 22 surrounds liner 86.

Figure 8:
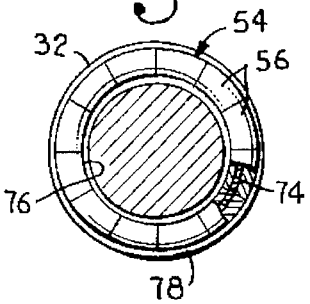
FIG. 8 is a cross-sectional view of the locking member in its retracted position taken along line 8—8 of FIG. 3 with portions broken away to illustrate details of construction.
Figure 9:
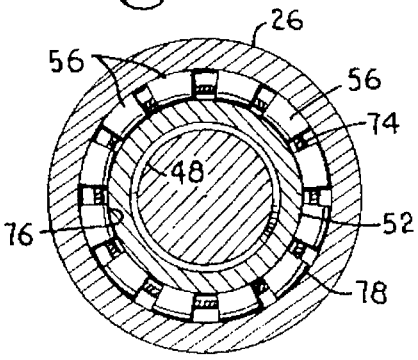
FIG. 9 is a cross-sectional view of the locking member in its extended position taken along line 9—9 of FIG. 7.
Figure 10:
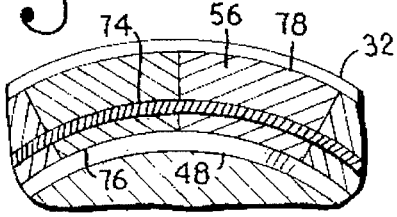
FIG. 10 is an enlarged fragmentary cross-sectional view showing the locking member in its retracted position.

FIG. 8 illustrates a locking ring 54 having twelve ring segments 56 wherein ring 54 is in its constricted or retracted position. Portions of two of the segments 56 are broken away to show the relative location of spring 74 within the segments 56. Likewise, FIG. 10 represents the position of spring 74 within member 54 when the ends of adjoining segments 56 are flush against one another. By contrast, segments 56 are spaced apart from one another when member 54 is in its extended or expanded position as shown in FIG. 9.

In a most preferred embodiment, collar 52 includes a chamfer 88 (FIGS. 4–6) disposed to force locking ring 54 outwardly into its expanded position as bolt 42 is tightened or moved downwardly into chamber 38. Alternatively, if desired, chamfer 88 could be formed integrally on the lower surface of bolt head 44 in disposition to expand the member 54. However, a separate collar 52 is preferable because collar 52 can rotate in either direction without turning bolt 42. Therefore, collar 52 is in position to dissipate any vibration which might otherwise tend to loosen the bolt. Also, collar 52 serves as a bearing when member 54 is locked into recess 70 in position to reduce the friction between bolt head 44 and locking member 54 as bolt 42 is being withdrawn from chamber 38. In the disclosed embodiment, collar 52 also presents an arcuate surface 90 which mates with surface 76 to partially embrace ring 54 when the ring is in its extended position.

In operation, probe 20 may be driven into the ground to a desired depth with drive point assembly 24 releasably locked to cutting shoe 26. Shoe 26 is connected to the forward end of sample tube 22, and drive head 30 is connected to the opposite end of sample tube 22. Liner 86, which is connected to cutting shoe 26, extends upwardly into tube 22 to receive and collect the soil sample.

Point 32 is slidingly received into shoe 26, and bolt 42 must be advanced longitudinally into chamber 38 to lock the drive point 32 into cutting shoe 26. As collar 52 is forced down onto locking ring 54, the chamfer 88 on the lower outer edge of collar 52 begins to spread ring 54 outwardly into its expanded position. Because assembly 24 is received in shoe 26 with ring 54 in close proximity to recess 70, the ring 54 will conveniently expand into recess 70. The arcuate surface 90 directly above chamfer 88 firmly holds ring 54 in annular groove 70. To this end, surface 90 and each of the inner contacting surfaces 76 will preferably have the same radius. Importantly, the diameter of bolt stem 46 must be appropriate for the dimensions of collar 52 and ring 54 to ensure that chamfer 88 is disposed in a position to initiate expansion of ring 54. Moreover, the diameter of stem 46 must be small enough to permit ring 54 to contract and also to clear recess 70 and sidewall 68 after collar 52 moves upwardly when point 32 is released.

A driving device, such as a hydraulic hammer (not shown), is used to drive probe 20 several feet into the ground. Next, probe rod 28 is connected to drive head 30 and the driving force is imparted to rod 28 so that probe 20 may be driven that much further into the ground. Additional probe rods (or extensions) may be connected to probe 20 as required to achieve the desired sampling depth. Each time the hammer hits a probe rod 28, the probe rod transfers the driving force down to the next adjacent probe rod 28, if any, and then to the drive head 30. In turn, the drive head 30 transfers that force to the sample tube 22 which passes it on to the cutting shoe 26. With the drive point 32 fixed securely in place, the top edge of the recess 70 in the shoe 26 transmits the driving force to the locking member 54. Member 54 then transmits that force to collar 52 and the top outer edge of the drive point 32. Since all of the components of the drive point assembly 24 are locked together, the force that drives the shoe 26 is transferred entirely to the point 32.

When the point 32 reaches the desired depth, the operator uses the appropriate length of extension rods (not shown) to lower release rod 80 through the hollow probe rods 28 (if any), through drive head 30 and into sample tube 22 until tool head 82 engages slot 84. Slot 84 is preferably formed within bolt head 44 in a half-moon configuration so that a complementally-shaped tool head 82 may conveniently drop into the center portion of slot 84 for transmitting the applied torque of the release rod 80. As a result, assembly 24 may be released from shoe 26 at any depth by rotating release rod 80 so that bolt 42 backs out of threaded chamber 38 enough to provide sufficient clearance for ring 54 to clear the sidewalls of shoe 26. The operator can tell when assembly 24 has been "released" because setscrew 58 will catch against the lower wall of groove 50 so that bolt 42 cannot be unscrewed further. Then, the extension rods and release rod 80 may be removed from the probe 20.

When the hammer is subsequently applied to probe 20, the driving force is still transmitted from the shoe 26 to the locking ring 54. However, when that force is transmitted from the ring 54 to collar 52, the collar simply moves up the stem 46 of the bolt 42. Consequently, the force from the shoe 26 will tend to move ring 54 out of recess 70 and into its retracted position since collar 52 no longer opposes the inward pulling force of spring 74. Once ring 54 resumes its retracted position, the driving force will bypass drive point assembly 24. Therefore, point 32 is free to travel upwardly within liner 86 and will thus remain stationary as probe 20 is driven deeper into the ground and soil enters liner 86.

Although the length of the sample tube may vary considerably for different applications, a typical length for a soil sample tube is four feet. In any event, probe 20 is usually driven a further distance of about the length of the sample tube into the ground after drive point 32 is released from cutting shoe 26. Drive head 30 is designed to stop the relative upward movement of assembly 24 once soil has filled the liner 86 inside sample tube 22. Depending on the consistency of the sample, it may not be necessary to seal off the forward end of cutting shoe 26 as the probe 20 is retracted from the ground.

Methods for retracting the sample tube 22 from the ground are well-known in the art. One convenient method for removing a sample tube involves connecting a pull cap (not shown) to the uppermost probe rod and extracting that probe rod from the ground until it is entirely above the surface. After disconnecting the uppermost probe rod, the pull cap is connected to the next probe rod, if any. These steps are repeated until the drive head 30 is exposed above the surface. Unlike the prior art, the drive point assembly 24 of the present invention does not protrude through the drive head 30 when the tube 22 contains a sample. Therefore, the pull cap may be conveniently placed on the drive head 30 for extracting the sample tube 22.

Drive point 32, collar 52 and ring segments 56 are made of shock resisting tool steel. Moreover, the collar 52 and drive point 32 are made of "hardened" tool steel. The ring segments 56 are configured to maximize the surface area deployed into the recess 70 while allowing member 54 to collapse sufficiently to clear the cutting shoe 26 when assembly 24 is released.

If the other threaded connections in probe 20 use right-handed threads, the threaded portion 48 of stem 46 and the threaded chamber 38 are preferably provided with left-handed threads. In such event, the use of tool head 82 of the release rod 80 to unscrew bolt 42 from chamber 38 will tend to tighten the other threaded connections which are of a reverse orientation.

Although an elongated, helical spring 74 is employed in the locking member 54 of the disclosed embodiment, other devices (e.g., an elastic band) could be used to perform the same function. The primary purpose of the spring is to hold the segments of member 54 together and to bias them to the retracted or constricted position of the member for clearing the inner walls of the shoe 26 except when drive point 32 is locked with shoe 26. Other devices, to provide this function, must have sufficient flexibility and resiliency to accommodate movement of the member between its extended position and its retracted position.

It will be recognized by those skilled in the art that the point locking function could be carried out by one or more retractable plungers rather than by a segmented ring member. Any construction which is easy to operate from ground level by means of an elongated tool, and which interconnects the point with the cutting shoe will suffice. The locking device heretofore described is considered to be particularly well-suited for this purpose.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. An apparatus for releasably locking a drive point at the leading end of an elongated tube including a cutting shoe having an inwardly opening recess in the sidewall of the shoe, said apparatus comprising:

a member carried by the drive point for movement therewith, said member being movable between an extended position with a portion of the member extending into the recess to lock the point to the tube, and a retracted position with the member clearing the recess and sidewall to permit relative movement between the point and the tube;

manually operable structure carried by the drive point and operably coupled with the member for moving the member between its extended and retracted positions; and wherein said point has an elongated threaded bore, said structure including a bolt threadably engaged in the bore for longitudinal movement in the bore responsive to manual rotation of the bolt, and means carried by the bolt and engageable with the member to cause the latter to move between said extended and retracted positions in response to said longitudinal movement of the bolt.

2. The apparatus set forth in claim 1, wherein the cutting shoe is formed integrally with the tube.

3. An apparatus for releasably locking a drive point at the leading end of an elongated tube including a cutting shoe having an inwardly opening recess in the sidewall of the shoe, said apparatus comprising:

a member carried by the drive point for movement therewith, said member being movable between an extended position with a portion of the member extending into the recess to lock the point to the tube, and a retracted position with the member clearing the recess and sidewall to permit relative movement between the point and the tube;

manually operable structure carried by the drive point and operably coupled with the member for moving the member between its extended and retracted positions; and wherein said member embodies a ring having a plurality of ring segments, each of said segments having a bore therethrough for disposing each of said segments eccentrically about an annular spring.

4. The apparatus set forth in claim 3, wherein the cutting shoe is affixed to the tube.

5. An apparatus for locking a drive point at the forward end of an elongated tube, said apparatus comprising:

a tapered drive point presenting a threaded chamber;

a bolt having a stem and a head, wherein the stem includes a threaded portion adapted for engaging the threaded chamber; and a locking member adapted for being carried by the stem in a retracted position and for being disposed in an extended position wherein a portion of said member occupies a mating recess formed near the forward end of the tube.

6. The apparatus set forth in claim 5, further comprising a collar disposed intermediate the locking member and the bolt head, said collar being adapted to promote movement of the member from its retracted position to its expanded position when the bolt is advanced into the chamber.

7. The apparatus set forth in claim 6, wherein the collar presents a chamfer for initiating the movement of the member from its retracted position to its extended position.

8. The apparatus set forth in claim 6, wherein the collar presents an arcuate surface for complementally receiving a portion of the member and for maintaining the member in its extended position.

9. The apparatus set forth in claim 5, wherein the locking member includes a plurality of locking segments having a circular cross-section.

10. The apparatus set forth in claim 9, wherein an annular spring passes through an eccentric bore formed in each locking segment.

11. The apparatus set forth in claim 5, wherein the drive point includes a lower conical portion and an upper cylindrical portion presenting the threaded chamber.

12. The locking device set forth in claim 11, wherein the upper section of the drive point is slightly tapered.

13. The apparatus set forth in claim 5, wherein the stem further comprises a groove adapted for receiving a setscrew through an aperture in the drive point to prevent the bolt from becoming completely disengaged from the threaded chamber.

14. The apparatus set forth in claim 5, further comprising means for receiving a tool for retracting the bolt from the threaded chamber.

15. The apparatus set forth in claim 14, wherein the receiving means is a slot formed in the bolt head.

16. The apparatus set forth in claim 5, wherein the locking member is ring-shaped.

17. The apparatus set forth in claim 5, wherein a cutting shoe is coupled to the forward end of the tube and the mating recess is formed in the cutting shoe.

18. The locking device set forth in claim 17, wherein the cutting shoe presents a slightly tapered inner surface for receiving the drive point.

19. The apparatus set forth in claim 5, wherein the elongated tube is the sample tube of a soil sampling probe.

20. The apparatus set forth in claim 5, wherein the orientation of the threads in the chamber and on the stem is the opposite of the orientation of other threads associated with the tube.

21. A method for releasably locking a drive point and an elongated tube together, said method comprising:

providing a tapered drive point presenting a threaded chamber;

providing a bolt having a stem and a head, wherein the stem includes a threaded portion adapted for engaging the threaded chamber;

engaging the threaded portion of the stem with the threaded chamber, wherein a locking member is disposed about the stem intermediate the drive point and the bolt head;

receiving the drive point into the tube; and advancing the bolt into the threaded chamber until the locking member is extended into a mating recess near the front end of the tube.

22. The method set forth in claim 21, wherein a collar is disposed about the stem intermediate the drive point and the bolt head for forcing the member into an extended position as the bolt is advanced into the chamber.

23. The method set forth in claim 22, further comprising the step of withdrawing the bolt from the threaded chamber so that the locking member will return to a retracted position and allow the drive point to be released from the tube.

24. The method set forth in claim 21, wherein the mating recess is formed in a cutting shoe connected to the forward end of the tube.

25. The method set forth in claim 21, wherein the locking member is annular.

* * * * *